US006863568B2

(12) United States Patent
Nakamura

(10) Patent No.: US 6,863,568 B2
(45) Date of Patent: Mar. 8, 2005

(54) CONNECTOR

(75) Inventor: Keiichi Nakamura, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/697,617

(22) Filed: Oct. 30, 2003

(65) Prior Publication Data

US 2004/0087209 A1 May 6, 2004

(30) Foreign Application Priority Data

Oct. 30, 2002 (JP) ..... 2002-315721

(51) Int. Cl.[7] ..... H01R 13/40
(52) U.S. Cl. ..... 439/595
(58) Field of Search ..... 439/595, 598, 439/752

(56) References Cited

U.S. PATENT DOCUMENTS 5,256,083 A 10/1993 Yamamoto
5,738,542 A * 4/1998 Jakobeit et al. ..... 439/595
5,820,411 A * 10/1998 Okabe ..... 439/595
5,904,593 A * 5/1999 Saito et al. ..... 439/595
6,165,011 A * 12/2000 Fukuda ..... 439/595
6,354,867 B1 * 3/2002 Tachi et al. ..... 439/488
6,375,503 B2 * 4/2002 Ohsumi ..... 439/595
6,716,069 B2 * 4/2004 Nakamura et al. ..... 439/595

* cited by examiner

*Primary Examiner*—Tho D. Ta
(74) *Attorney, Agent, or Firm*—Harness, Dickey & Pierce P.L.C.

(57) ABSTRACT

A connector housing has a terminal insertion opening (32) formed on a front wall (30) of a cavity (23) formed in a tower part (21). A tapered guide surface (33) is formed on a front peripheral edge of the terminal insertion opening (32). An open groove (35) is formed forward of the lance (27) on a lower portion of the peripheral edge of the terminal insertion opening (32). A retainer (40) for unremovably doubly locking a female terminal can be mounted in the tower part (21). An auxiliary plate (60) projects from a lower portion of a peripheral edge of each window hole (43) of the retainer (40). A supplementary tapered guide surface (33A) is formed on a surface of an upper end of the auxiliary plate (60). A jig insertion hole (64) is formed on the auxiliary plate (60). When the retainer (40) is mounted in a main locking position, the auxiliary plate (60) fits into a cut-off portion of the peripheral edge of the terminal insertion opening (32). Thus, substantially all the peripheral edge of the terminal insertion opening (32) is surrounded with the guide surfaces (33) and (33A).

1 Claim, 14 Drawing Sheets

(A)

(B)

CONNECTOR

CROSS-REFERENCE TO RELATED APPLICATIONS

The entire disclosure of Japanese Patent Application No. 2002-315721 filed on Oct. 30, 2002 including the specification, claims, drawings and summary is incorporated herein by reference in its entirety.

FIELD OF THE INVENTION

The present invention relates to female connectors that accommodate female terminals.

BACKGROUND OF THE INVENTION

An example of a female connector, shown in Japanese Patent Application Laid-Open No. 63-257187 is described below with reference to FIG. 17. When the female terminal 3 is inserted into the cavity 2 formed in the female housing 1, the female terminal 3 is primarily locked in an unremovable state by the lance 4 formed on the bottom wall of the cavity 2. Thereafter the retainer 5 is pressed into the flexible space 6 of the lance 4 to doubly lock the female terminal 3 by regulating the elastic deformation of the female terminal 3.

The terminal insertion opening 7 is formed on the front wall 2A of the cavity 2. The tapered guide surface 8 is formed on the peripheral edge of the terminal insertion opening 7. When the female housing 1 accommodating the female terminal 3 and the mating male housing are fit on each other, the tab of the mating male terminal is inserted straight into the terminal insertion opening 7 while the male terminal is guided by the guide surface 8, if necessary. Thus, the male terminal and the female terminal 3 are connected to each other.

A jig insertion opening 9 that reaches the lance 4 is formed on the front wall 2A of the cavity 2. When the female terminal 3 is pulled out from the cavity 2 for maintenance, the retainer 5 is returned to the position shown in FIG. 17A. Then a jig is inserted into the cavity 2 from the jig insertion opening 9 so that the lance 4 caught by the jig is forcibly elastically deformed into the flexible space 6. As a result, the female terminal 3 is unlocked from the lance 4. Thus the female terminal 3 can be pulled out from the cavity 2 by pulling an electric wire W.

In order to form the jig insertion opening 9 to unlock the female terminal in the connector, the jig insertion opening 9 is formed by cutting off a part (lower side) of the peripheral edge of the terminal insertion opening 7 in compliance with demands for miniaturization of the female housing 1.

In this case, the guide surface 8 of the female terminal 3 is not formed on the entire peripheral edge of the terminal insertion opening 7. Thus there is a possibility that depending on the inclination direction of the tab of the male terminal, the male terminal tab will not be guided properly. The tab may strike an unnecessary portion of the female terminal 3 or pierce the side wall of the jig insertion opening 9.

Still other objects and advantages of the invention will become apparent from the following specification.

SUMMARY OF THE INVENTION

The present invention has been made in view of the above-described shortcomings. Accordingly, it is an object of the present invention to securely guide a mating male terminal tab into a cavity.

According to the present invention, a connector including a cavity is accommodated in a connector housing which receives a female terminal. An elastically deformable lance, formed on a side wall of the cavity, unremovably locks the female terminal in the housing. A terminal insertion opening, formed on a front wall of the cavity, receives a tab of a mating male terminal. A tapered guide surface is formed on a front peripheral edge of the terminal insertion opening to guide the tab of the male terminal into the terminal insertion opening. A jig insertion opening is formed forward of the lance by cutting off a part of the front peripheral edge of the terminal insertion opening. This enables an insertion of a jig to forcibly elastically deform the lance to unlock the female terminal.

An auxiliary member, having a guide surface for supplementing at least one portion of the cut-off part formed thereon, can be mounted on the connector housing.

Preferably, a retainer for doubly locking the female terminal is unremovably mounted in the cavity. The retainer has a guide surface for partly supplementing the cut-off part.

According to the above-described construction, when the auxiliary member is mounted on the connector housing, the guide surfaces are disposed on almost all of the peripheral edge of the terminal insertion opening. Therefore, irrespective of postures of the tab of the male terminal advancing to the terminal insertion opening, the male terminal tab is inserted straight into the housing. The male terminal tab is guided by the guide surfaces. Accordingly the male terminal can be normally connected to the mating female terminal without the tab of the male terminal piercing into or striking against an unnecessary portion of the housing.

Further when the retainer is mounted on the connector housing to doubly lock the female terminal, the guide surfaces are disposed on almost all of the peripheral edge of the terminal insertion opening.

Further areas of applicability of the present invention will become apparent from the detailed description provided hereinunder. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

An embodiment of the present invention will be described below with reference FIGS. 1 through 16.

Figure 1:
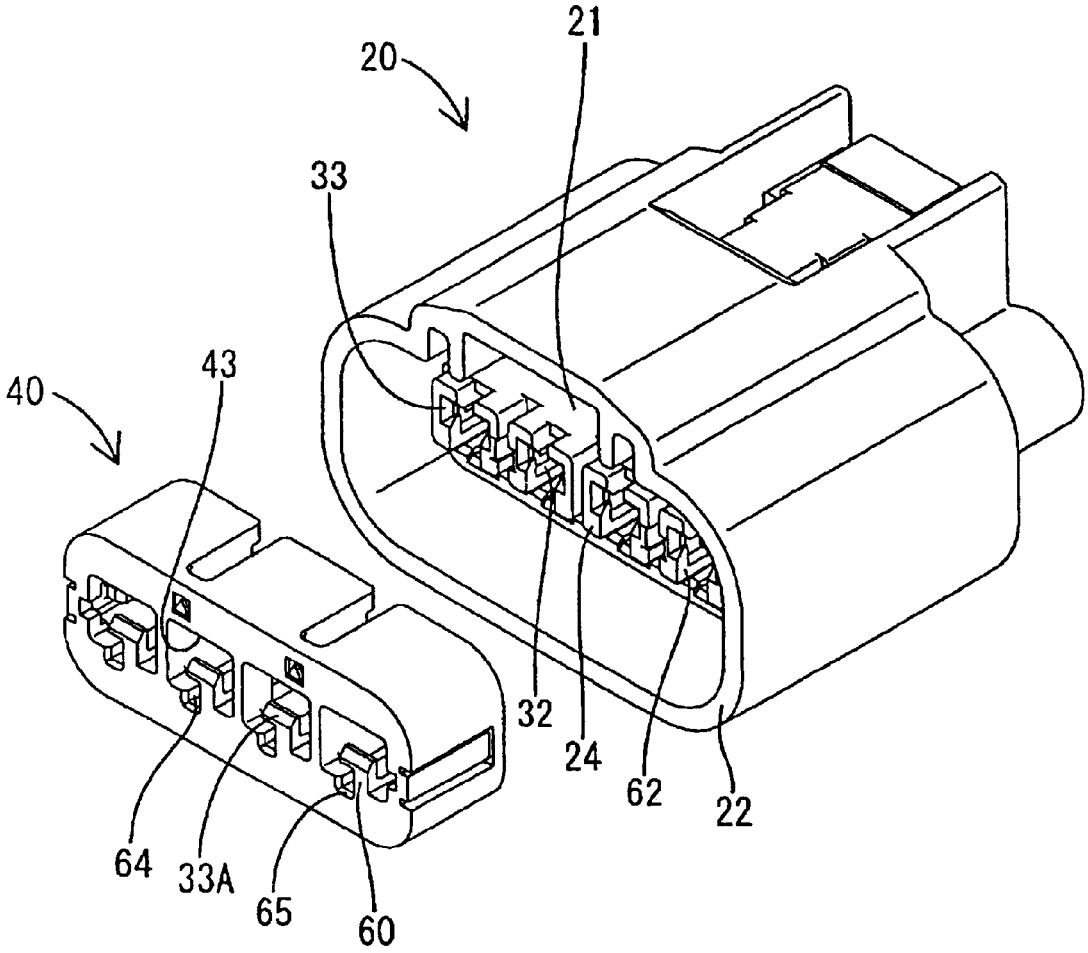
FIG. 1 is a perspective view of a female housing of a female connector and a retainer.
Figure 2:
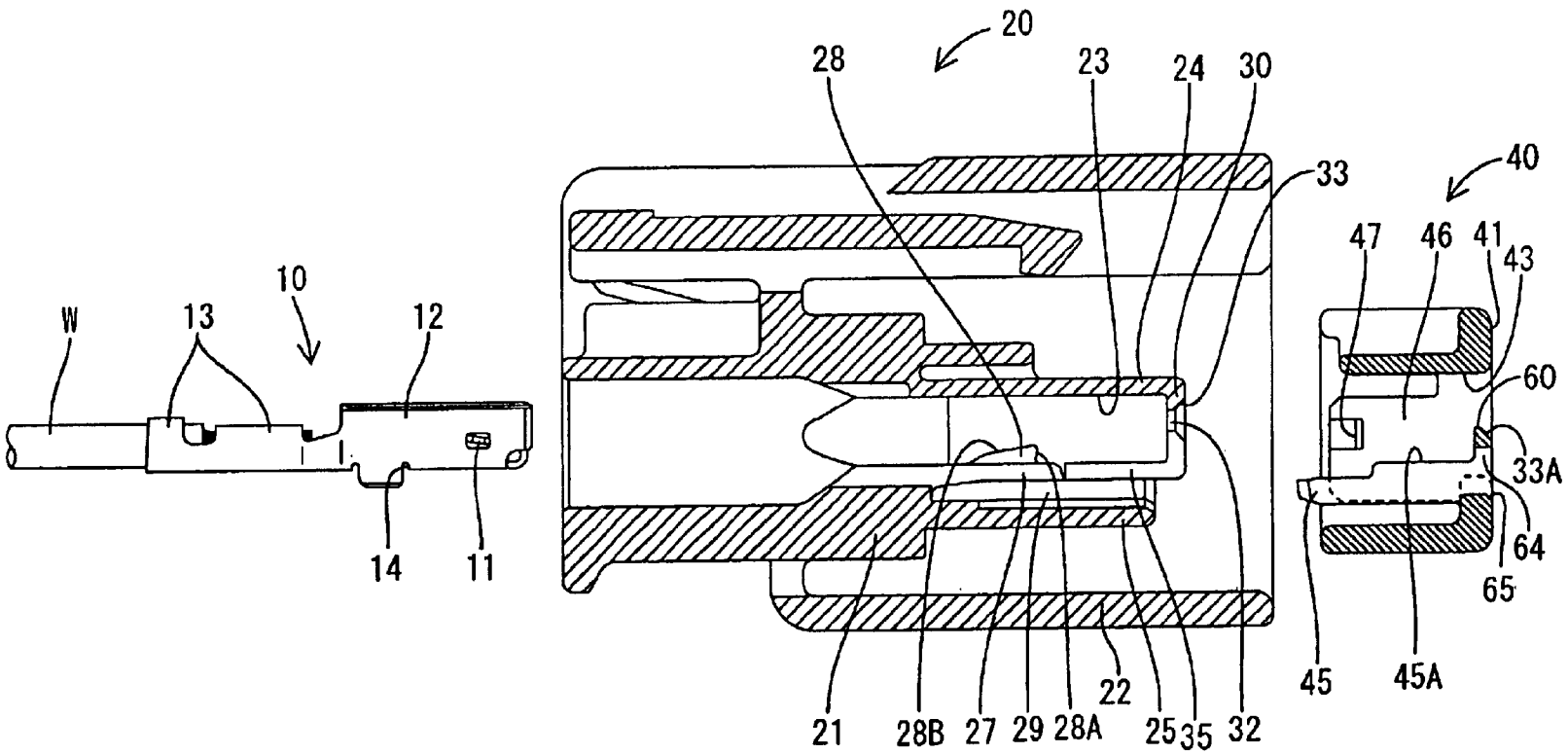
FIG. 2 is an exploded vertical sectional view of the female connector.

It is to be noted that the left side in FIG. 2 is set as the rear side, whereas the right side in FIG. 1 is set as the front side.

As shown in FIGS. 1 and 2, four female terminals 10 are accommodated in a female connector housing (hereinafter referred to as female housing) 20 and doubly locked in an unremovable state by a retainer 40.

The female terminal 10 is formed by press working of a metal plate having superior electric conductivity. A flat and square pillar-shaped connection portion 12 is formed at a front side of the female terminal 10. An elastic contact piece 11 is formed at the front side of the female terminal 10. The contact piece 11 is capable of contacting a tab 16 (see FIG. 15) of a mating male terminal 15. The connection portion 12 is fixed to an end of an electric wire W by caulking a barrel 13 disposed at a rear side of the female terminal 10. A locking hole 14, in which a lance 27 fits, is formed on a bottom surface of the connection portion 12. The lance 27 will be described later.

Figure 3:
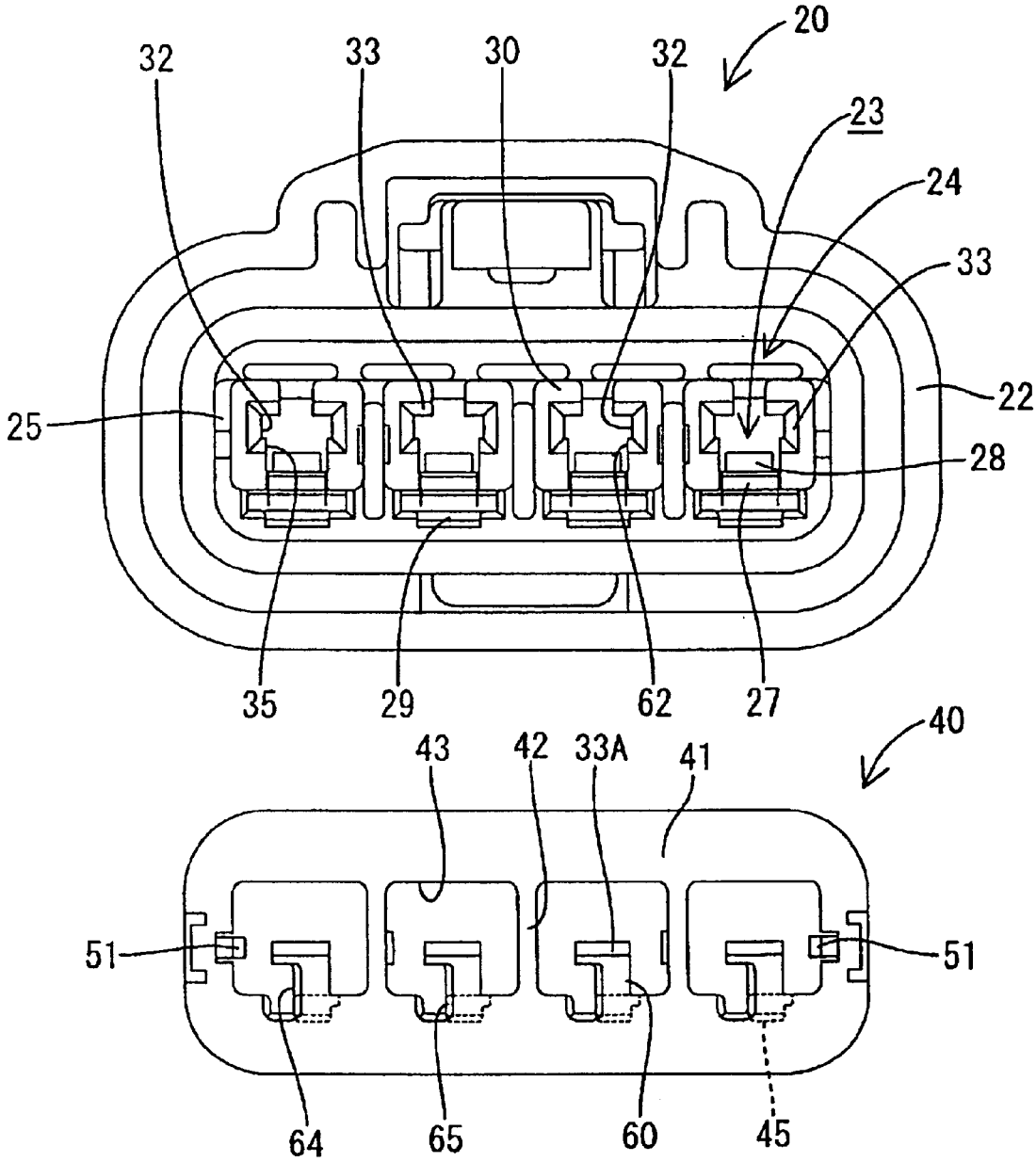
FIG. 3 is a front view of the female housing and the retainer.
Figure 4:
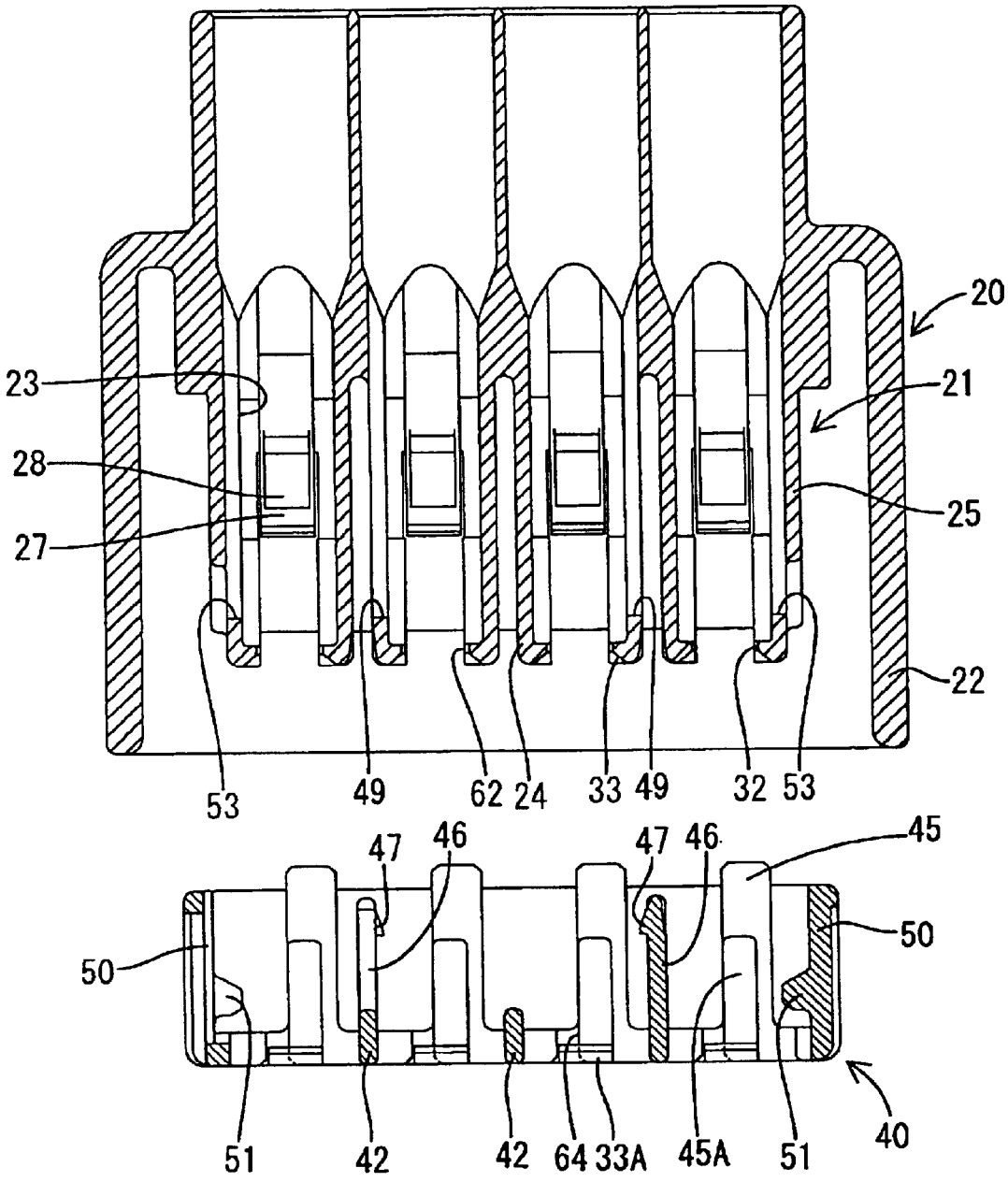
FIG. 4 is a plan sectional view of the female housing and the retainer.

The female housing 20 is made of a synthetic resin. As shown in FIGS. 3 and 4, a hood part 22 is formed on the periphery of an almost flat tower part 21. The hood part 22 projects from the front-half portion to a position a little forward from the front end of the tower part 21. Four cavities 23 are arranged widthwise in the tower part 21. The front side of the tower part 21 is divided into four terminal accommodation portions 24 corresponding to the four cavities 23. A peripheral wall 25 is formed on the periphery of each of the terminal accommodation portions 24. As shown in FIG. 2, a projected end of a lower surface of the peripheral wall 25 is located a little rearward from a front surface of the terminal accommodation portion 24. A projected end of right and left side surfaces of the peripheral wall 25 and that of an upper surface thereof are located stepwise rearward from the projected end of the lower surface of the peripheral wall 25.

A lance 27 is formed integrally with a bottom surface of each cavity 23. The lance 27 is cantilevered on the bottom surface of each cavity 23. A projection 28, capable of fitting in the locking hole 14 of the female terminal 10, is formed in the vicinity of a front end of an upper surface of the lance 27. A front surface of the projection 28 is almost vertical so that the front surface serves as a locking surface 28A. A rear side of the projection 28 is downgrade so that the rear side serves as a guide surface 28B. The front side of the lance 27 is deformable into a flexible space 29 disposed below the lance 27.

Thus when the female terminal 10 is inserted from the rear into the cavity 23, the lance 27 is pressed into the flexible space 29, with the lance 27 being elastically deformed. When a front end of the connection portion 12 reaches a position where it contacts a front wall 30 of the cavity 23, the projection 28 fits in the locking hole 14. The female terminal is primarily locked in an unremovable state with the lance 27 being restored to its original state (see FIG. 12).

A terminal insertion opening 32 is formed on the front wall 30 of the cavity 23. The tab 16 of the mating male terminal 15 is inserted into the cavity 23. As shown in FIG. 3, the terminal insertion opening 32 is widthwise long and rectangular in conformity to the sectional configuration of the tab 16. A tapered guide surface 33 is formed on the front peripheral edge of the terminal insertion opening 32 to guide the tab 16 of the male terminal 15 into the terminal insertion opening 32. The tab 16 of the male terminal 15 is straight (horizontal).

On the bottom wall of the cavity 23, an open groove 35 is formed forward from the lance 27. The open groove 35 has a width equal to that of the lance 27. The groove 35 is open forward, with a lower portion of the peripheral edge of the terminal insertion opening 32 cut off. Thus the widthwise lower side of the guide surface 33 is almost entirely cut off. As will be described later, the open groove 35 is used to insert a jig J (see FIG. 16) to unlock the female terminal 10 from the cavity 23. The female terminal 10 is unlocked from the lance 27 by pressing the lance 27 into the flexible space 29. Accordingly, the lance 27 is forcibly elastically deformed.

The central portion of the upper side of the guide surface 33 is cut off at a much lower degree than the lower side. Thus the influence of the cut-off on the upper side can be ignored.

Figure 5:
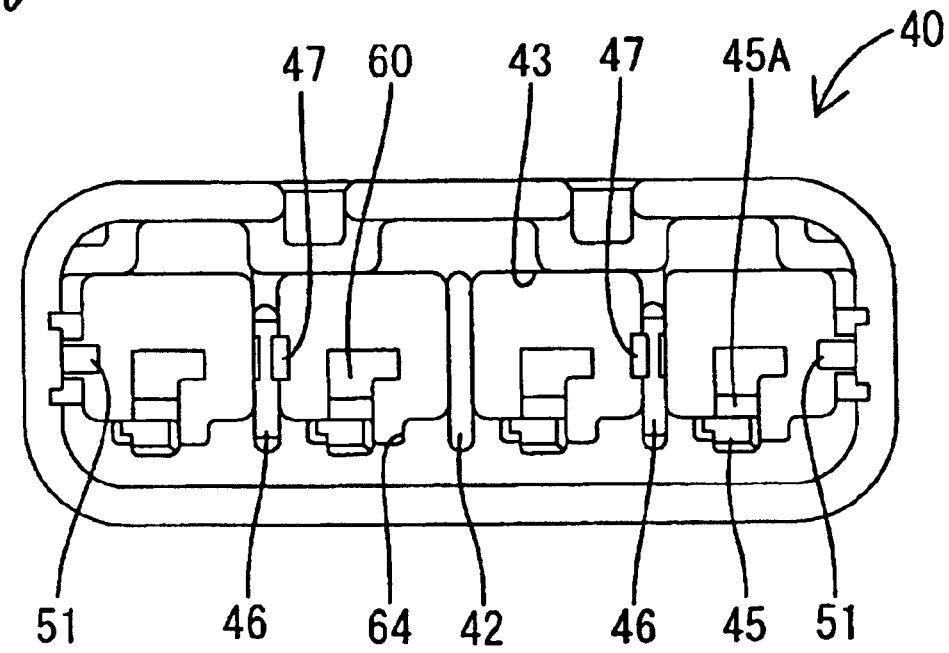
FIG. 5 is a rear view of the retainer.
Figure 6:
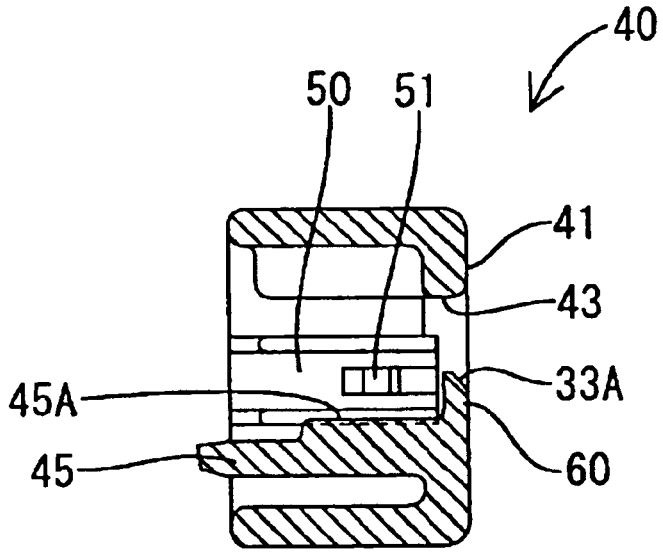
FIG. 6 is a vertical sectional view of the retainer.
Figure 7:
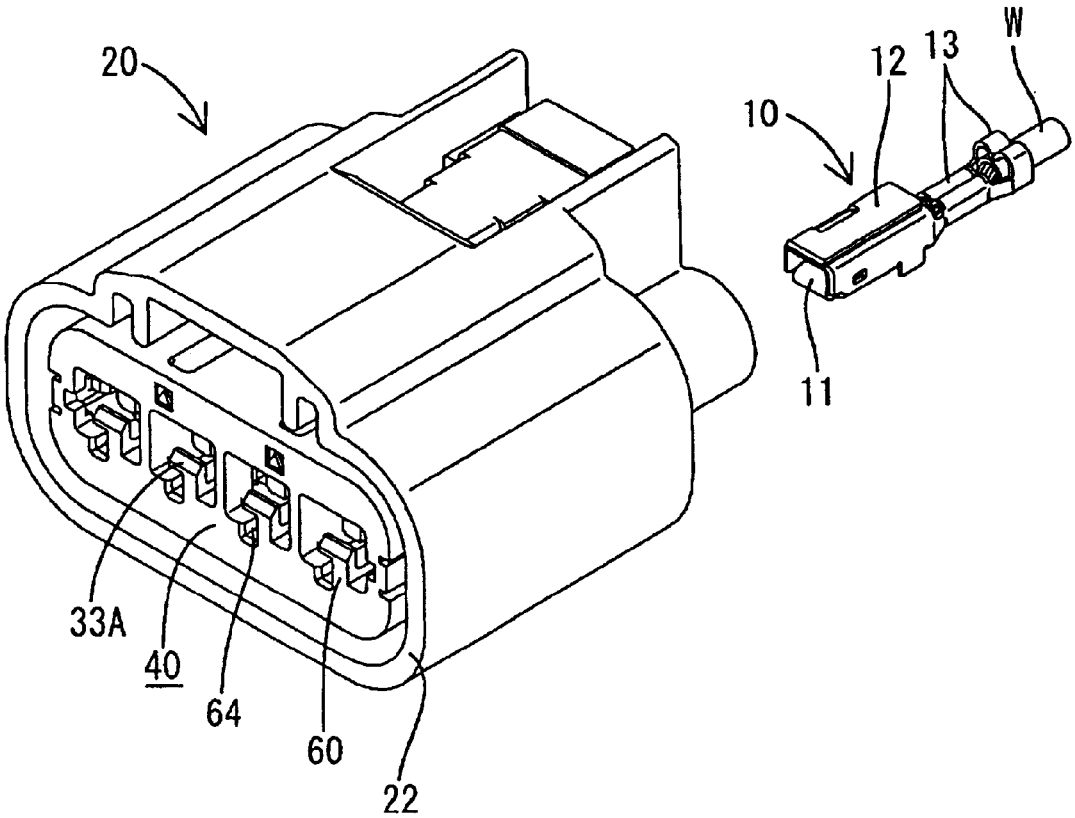
FIG. 7 is a perspective view showing an operation of inserting a female terminal into the female housing.

To doubly lock the female terminal 10, a retainer 40 of a front type is mounted on the tower part 21 at its front end. The retainer 40 is also made of a synthetic resin. As shown in FIGS. 5 and 6, the retainer 40 is widthwise long and cap-shaped to entirely cover the front end and periphery of the tower part 21.

A front plate 41 of the retainer 40 is partitioned by a partitioning wall 42. The wall 42 projects rearward to form four window holes 43. The window holes 43 are arranged widthwise in correspondence to the number of the cavities 23 of the tower part 21, namely, four cavities 23. The partitioning wall 42 is capable of almost tightly entering the gap between the terminal accommodation portions 24. A regulation piece 45 projects rearward from a lower portion of the peripheral edge of each window hole 43.

In a front view (see FIG. 3), the regulation piece 45 is disposed from the widthwise center of each window hole 43 to the right-hand side. The regulation piece 45 enters the flexible space 29 of the lance 27 formed in each cavity 23 preventing an elastic deformation of the lance 27. A receiving base 45A, to receive the lower surface of the front side of the connection portion 12 of the female terminal 10, is normally inserted into the cavity 23. The base 45A is formed on an upper surface of the root side of the regulation piece 45.

The retainer 40 is held in the tower part 21 at a temporary locking position and a main locking position inward into the tower part 21.

As shown in FIG. 4, as temporary locking means, the retainer 40 has a temporary locking piece 46 projecting rearward from the right-hand partitioning wall 42 and the left-hand partitioning wall 42. Further the retainer 40 has a hook portion 47 formed on an opposed surface of a projecting end of each temporary locking piece 46. The female housing 20 has a rearward open temporary locking groove 49 (see FIG. 9) formed on an outer surface of each of the central two terminal accommodation portions 24 to receive the temporary lock means. The hook portion 47 fits in the temporary locking groove 49.

The retainer 40 has an elastically deformable main locking piece 50 formed on an inner surface of the right and left side walls. A locking projection 51 is on an opposed surface of each main locking piece 50. The locking projection 51 has inclined front and rear sides to enable the locking projection 51 to have a semi-locking construction. The female housing 20 has a main locking hole 53. The main locking hole 53 is formed on an outer surface of each of the right-hand and left-hand terminal accommodation portions 24 and right-hand and left-hand side surfaces of the peripheral wall 25. The locking projection 51 fits in the main locking hole 53.

Figure 8:
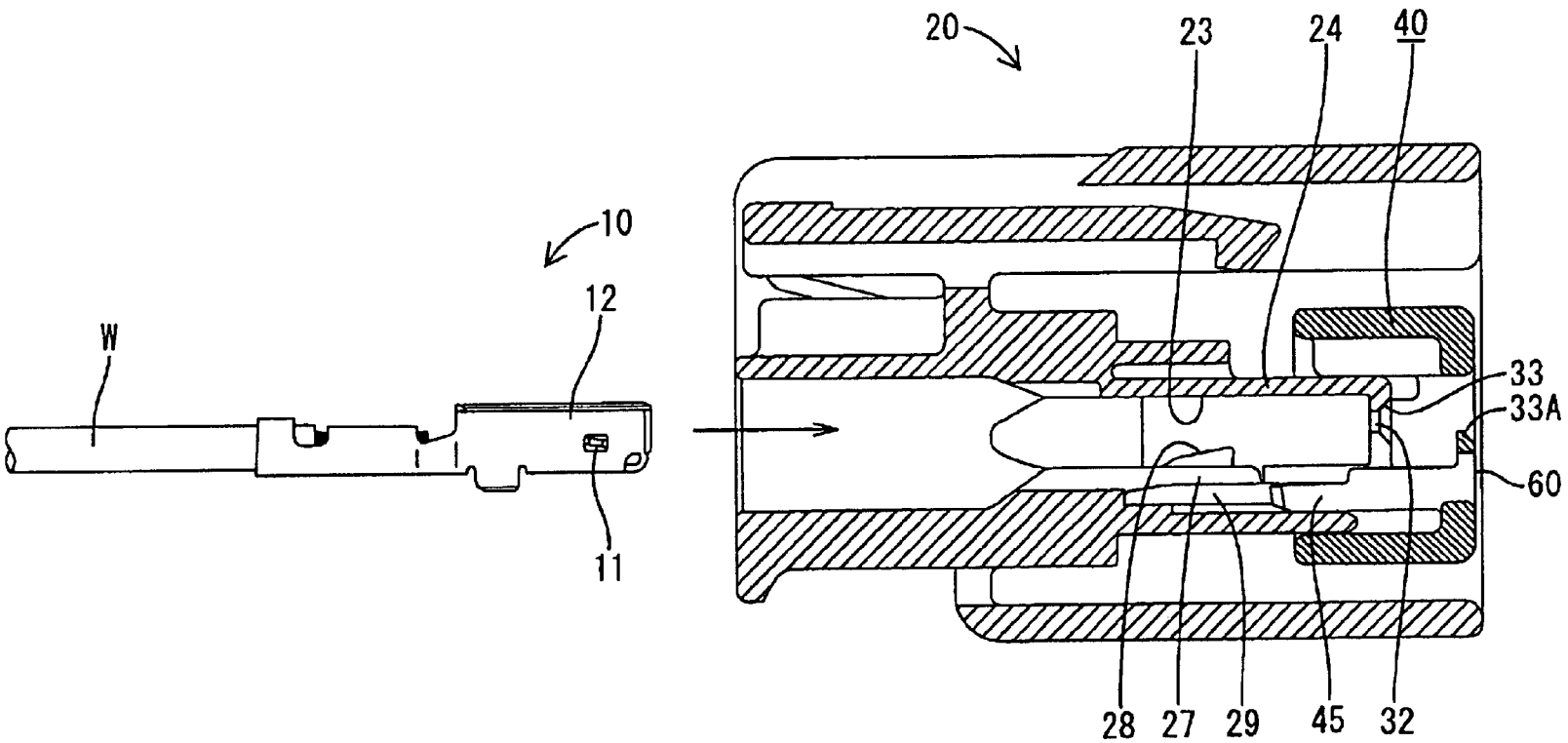
FIG. 8 is a vertical sectional view showing the operation of inserting the female terminal into the female housing.
Figure 9:
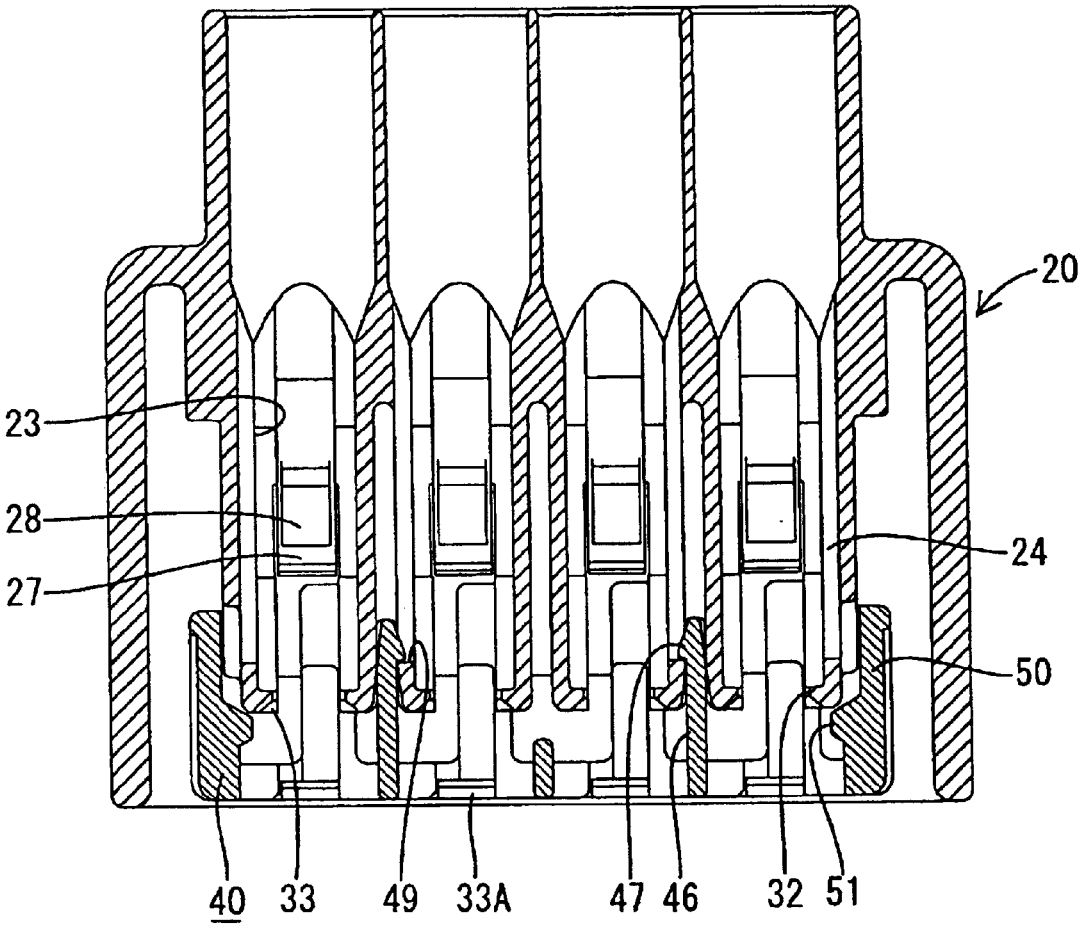
FIG. 9 is a plan sectional view showing a state in which the retainer is temporarily mounted at a temporary locking position.
Figure 10:
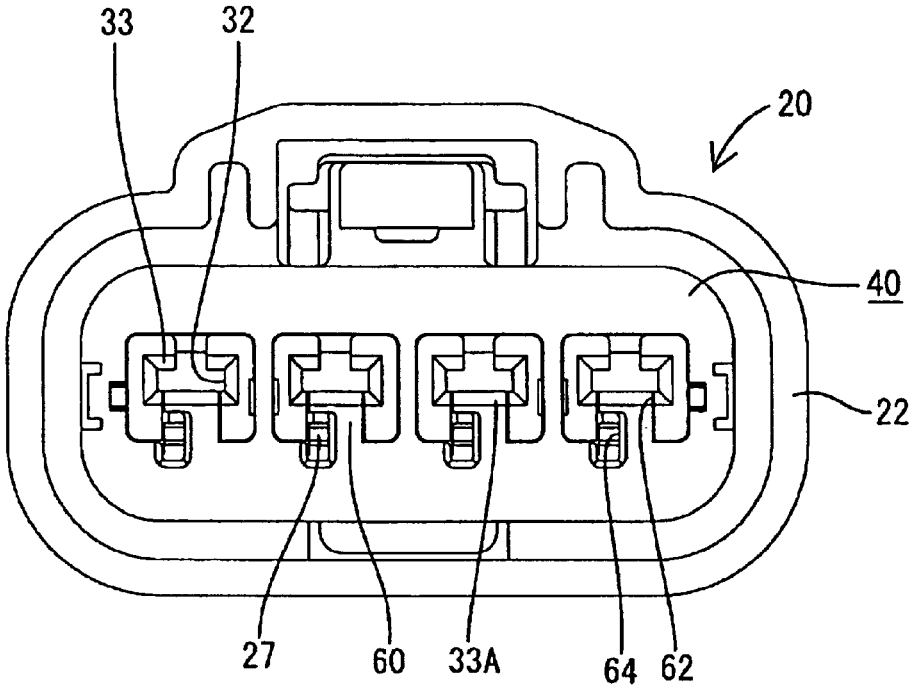
FIG. 10 is a front view showing the state in which the retainer is temporarily mounted at the temporary locking position.

In this construction, initially the retainer 40 is fitted in the tower part 21 of the female housing 20. Then the front plate 41 of the retainer 40 is pressed into a position a little rearward from the front end of the hood part 22, as shown in FIG. 9. As a result, the locking projection 51 of the main locking piece 50 strikes an outer front corner of the right-hand and left-hand terminal accommodation portions 24. The hook portions 47 of the temporary locking pieces 46 fit in the temporary locking grooves 49 of the central two terminal accommodation portions 24. Thereby the retainer 40 is held at the temporary locking position. At the temporary locking position, as shown in FIG. 8, the regulation piece 45 of the retainer 40 is disposed forward from the flexible space 29 of the lance 27. Accordingly, this enables the elastic deformation of the lance 27.

Figure 14:
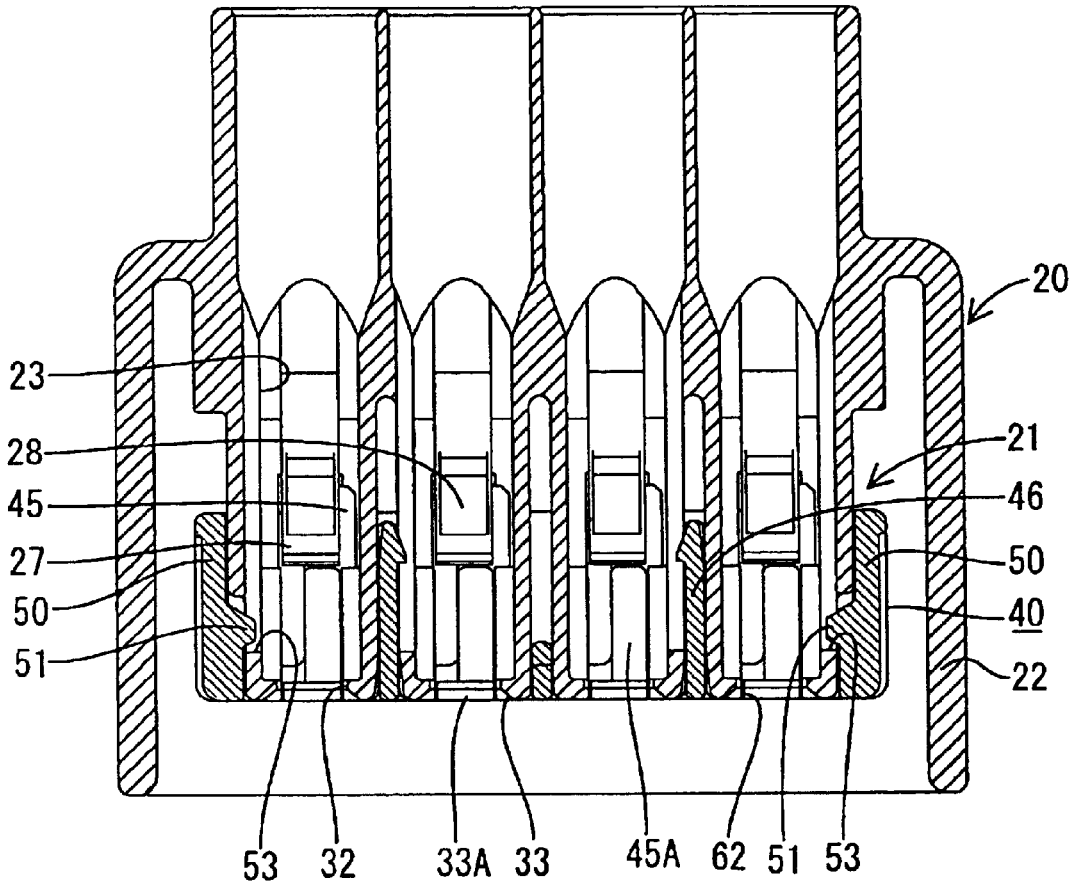
FIG. 14 is a plan sectional view showing the retainer pressed into a main locking position.
Figure 15:
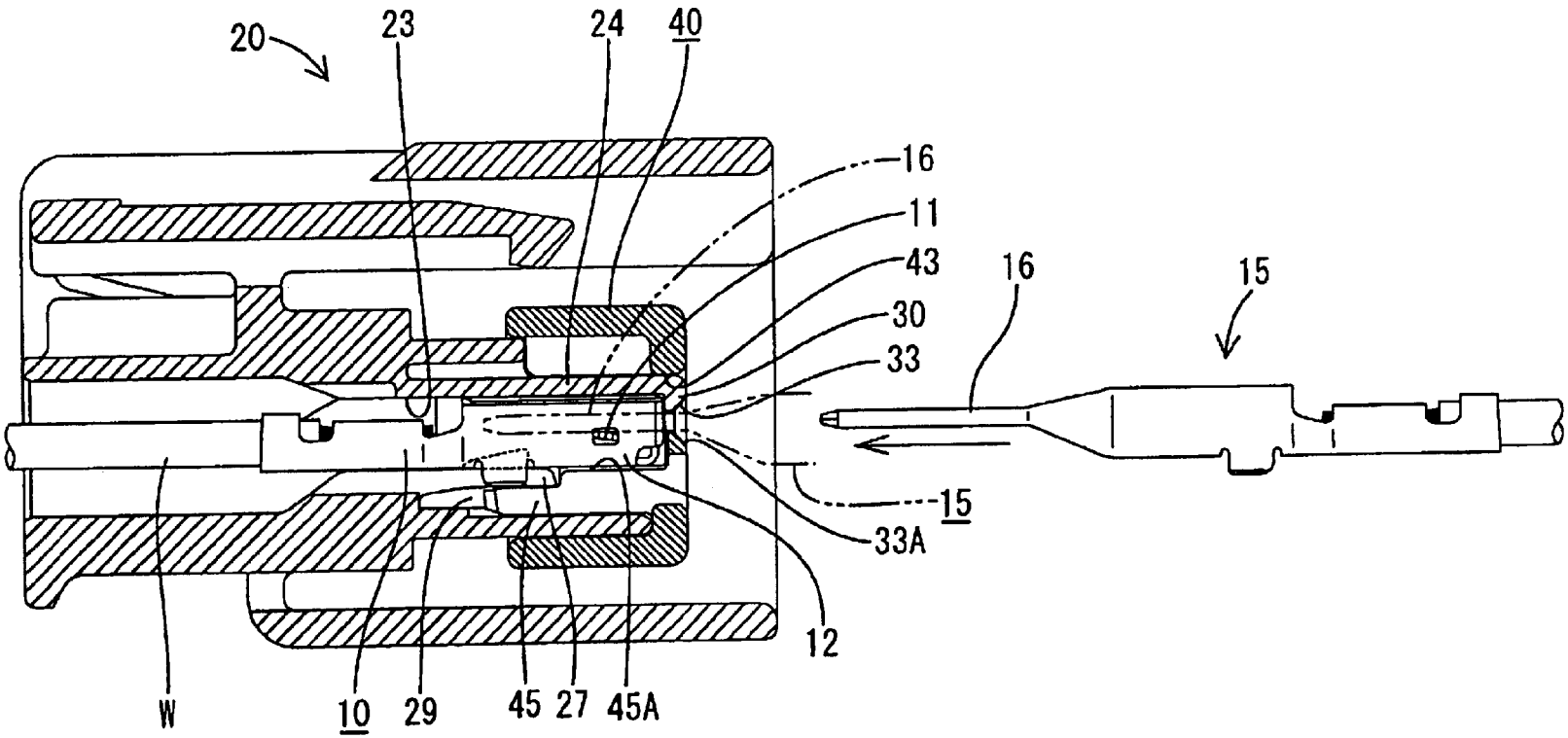
FIG. 15 is a vertical sectional view showing an operation of fitting the female connector and a mating male connector on each other.

When the retainer 40 at the temporary locking position is pressed to a position where the rear surface (forward side in insertion direction) of the front plate 41 contacts the projected end of the lower surface of the peripheral wall 25, as shown in FIG. 14, the locking projection 51 of the main locking piece 50 fits in the main locking hole 53. The retainer 40 is held in the main locking position. As shown in FIG. 15, in the main locking position, the regulation piece 45 of the retainer 40 enters the flexible space 29 of the lance 27. Also, the front wall 30 of each cavity 23 fits in the corresponding window hole 43. Thus, the front wall 30 and window hole 43 are flush with each other.

An auxiliary plate 60 projects from the lower portion of the peripheral edge of each window hole 43 of the retainer 40. When the retainer 40 is held in the main locking position, the auxiliary plate 60 fits almost tightly in a cut-off portion 62 formed at the lower portion of the peripheral edge of the terminal insertion opening 32 formed on the front wall 30 of each terminal accommodation portion 24 (see FIG. 13). A tapered guide surface 33A is formed on the surface of the upper end of the auxiliary plate 60. When the auxiliary plate 60 fits in the lower portion of the peripheral edge of the terminal insertion opening 32, the guide surfaces 33A and the guide surface 33 formed on the front wall 30 are disposed on the entire peripheral edge of the terminal insertion opening 32.

An insertion hole 64 is formed in a region whose area is a little smaller than the area of the left half of the auxiliary plate 60 in a front view. The insertion hole 64 is for the unlocking jig J. The hole 64 is formed at a position a little lower than the position where the guide surface 33A is formed to a position a little lower than the lower portion of the peripheral edge of the window hole 43. The jig insertion opening 64 is aligned with the front end of the lance 27 through the open groove 35. A tapered guide surface 65 is formed on the front peripheral edge of the jig insertion opening 64.

The operation of the connector of the embodiment having the above-described construction is described below.

Figure 11:
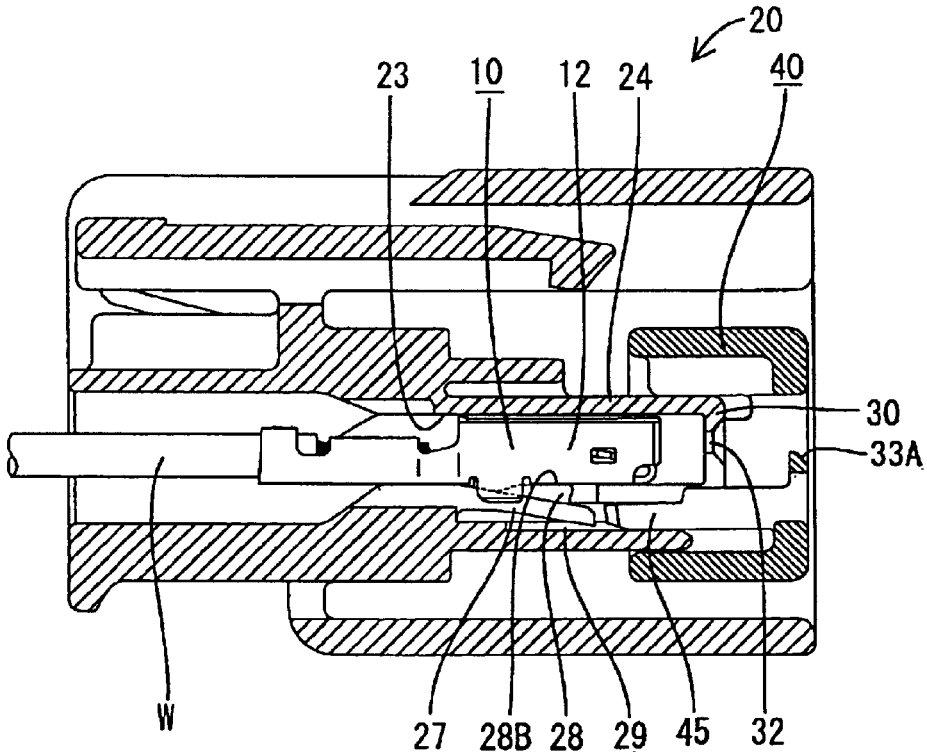
FIG. 11 is a vertical sectional view showing the female terminal being inserted into the female housing.

Initially, the retainer 40 is placed on the front end of the tower part 21 of the female housing 20 and held at the temporary locking position, as shown in FIGS. 7 through 10. At the temporary locking position, as shown in FIG. 8, the regulation piece 45 of the retainer 40 is disposed forward of the flexible space 29 of the lance 27. In this state, as shown with an arrow of FIG. 8, the female terminal 10, crimped to the end of the electric wire W, is inserted into the corresponding cavity 23, from the rear of the female housing 20. While the female terminal 10 is inserted into the cavity 23, the front surface of the connection portion 12 of the female terminal 10 strikes the guide surface 28B of the projection 28 of the lance 27. As a result, as shown in FIG. 11, the lance 27 is pressed into the cavity 29, with the lance 27 elastically deforming.

Figure 12:
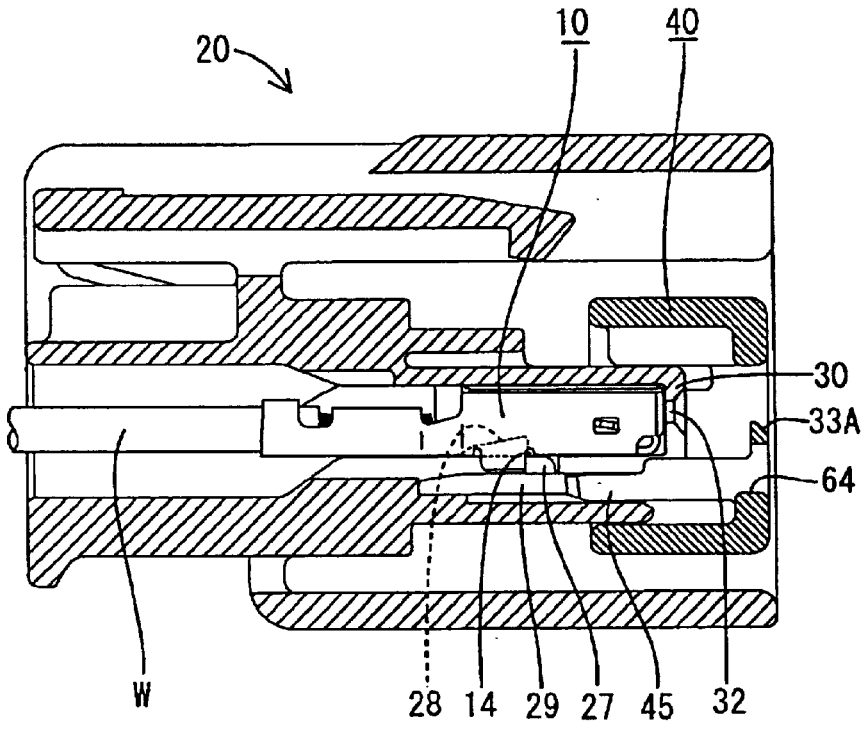
FIG. 12 is a vertical sectional view showing the female terminal normally inserted into the female housing.

When the female terminal 10 is pressed to the position where the front end of the connection portion 12 strikes the front wall 30 of the cavity 23, the locking hole 14 reaches the position of the projection 28. As shown in FIG. 12, the lance 27 is restored to its original state. The projection 28 fits in the locking hole 14. Thus, the female terminal 10 is primarily locked in position.

Figure 13:
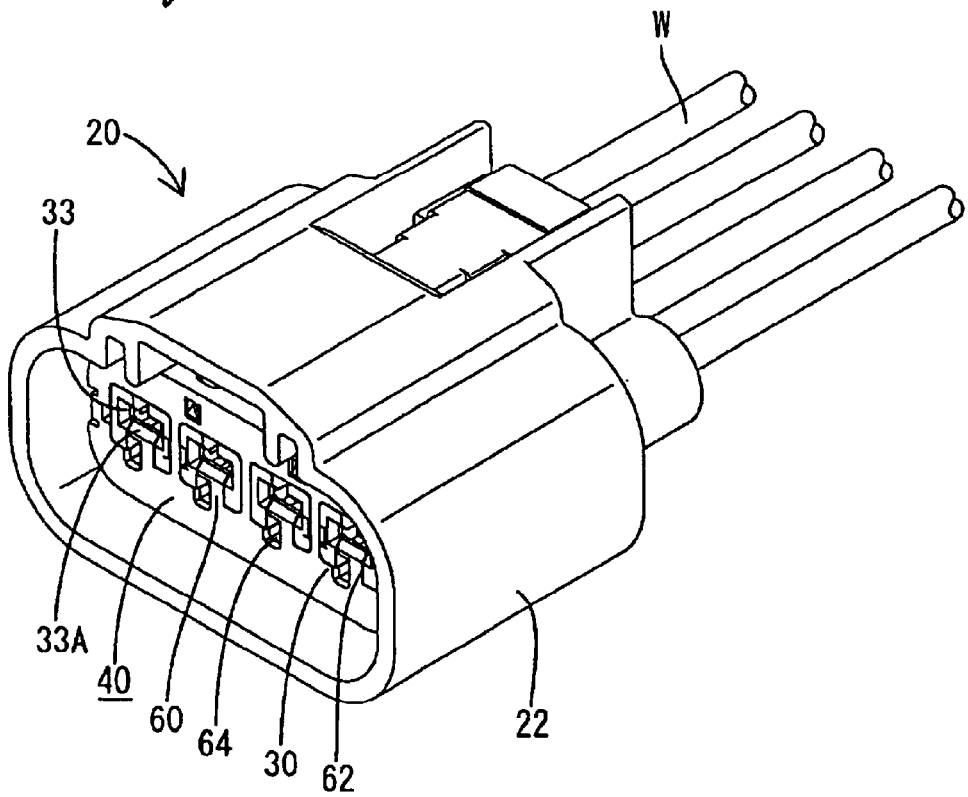
FIG. 13 is a perspective view showing the retainer pressed into a main locking position.

When insertion of all the female terminals 10 is completed, the retainer 40 disposed at the temporary locking position is pressed rearward (forward in insertion direction) and held in the main locking position, as shown in FIGS. 13 through 15. The female terminal 10 is not shown in FIG. 14. When the retainer 40 is held in the main locking position, as shown in FIG. 15, while the receiving base 45A receives the lower surface of the connection portion 12 of the female terminal 10, the regulation piece 45 enters the flexible space 29. Thus, this regulates the elastic deformation of the lance 27. Accordingly, the female terminal 10 is indirectly doubly locked in an unremovable state.

At this time, as shown in FIG. 13, the auxiliary plate 60 of the retainer 40 fits on the cut-off portion 62 of the front wall 30 of each terminal accommodation portion 24 to form the terminal insertion opening 32. Almost all of the peripheral edge of the terminal insertion opening 32 is surrounded with the guide surfaces 33 and 33A (see FIG. 10).

After the female connector is assembled as described above, the female connector and a male connector (not shown) are fitted onto each other. In consequence, as shown with the arrow of FIG. 15, the tab 16 of the male terminal 15 is inserted into the cavity 23 from the terminal insertion opening 32 of the corresponding terminal accommodation portion 24 of the female housing 20. The guide surfaces 33 and 33A are disposed around substantially all the peripheral edge of the terminal insertion opening 32. Thus irrespective of the inclination direction of the male terminal tab 16 advancing into the terminal insertion opening 32 of the terminal accommodation portion 24, the male terminal tab 16 is inserted into the opening 32. The male terminal tab 16 is guided by the guide surfaces 33 or 33A. In this manner, the male terminal 15 is normally connected to the mating female terminal 10.

When the female terminal 10 is pulled out of the female housing 20 for maintenance, the female connector is initially separated from the male connector. Next the retainer 40, in the main locking position, is pulled to return the retainer 40 from the main locking position to the temporary locking position shown in FIG. 12 by utilizing the semi-locking construction. Accordingly, the regulation piece 45 moves forward from the flexible space 29. This enables the elastic deformation of the lance 27.

Figure 16:
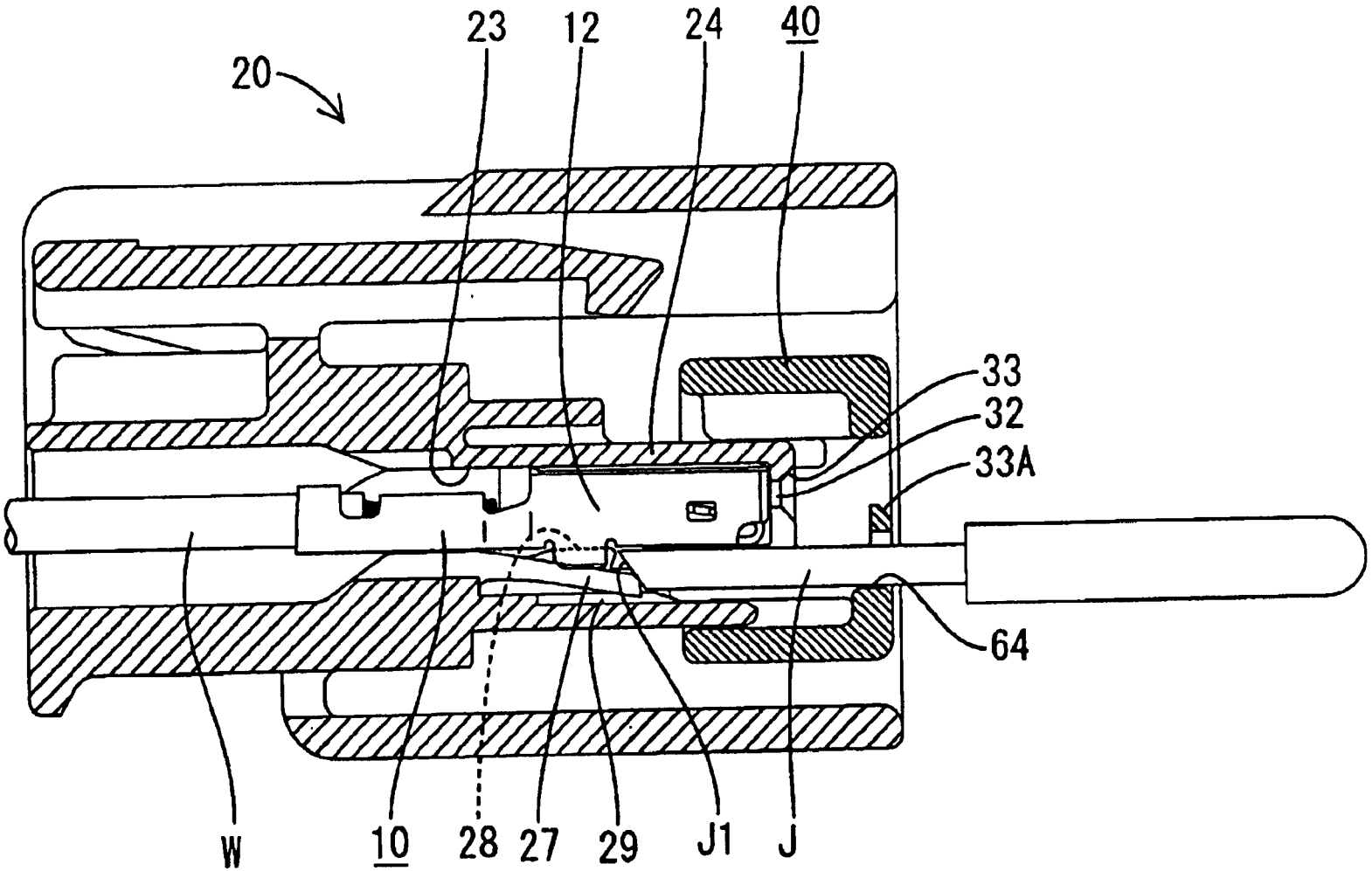
FIG. 16 is a vertical sectional view showing an operation of unlocking a lance.
Figure 17:
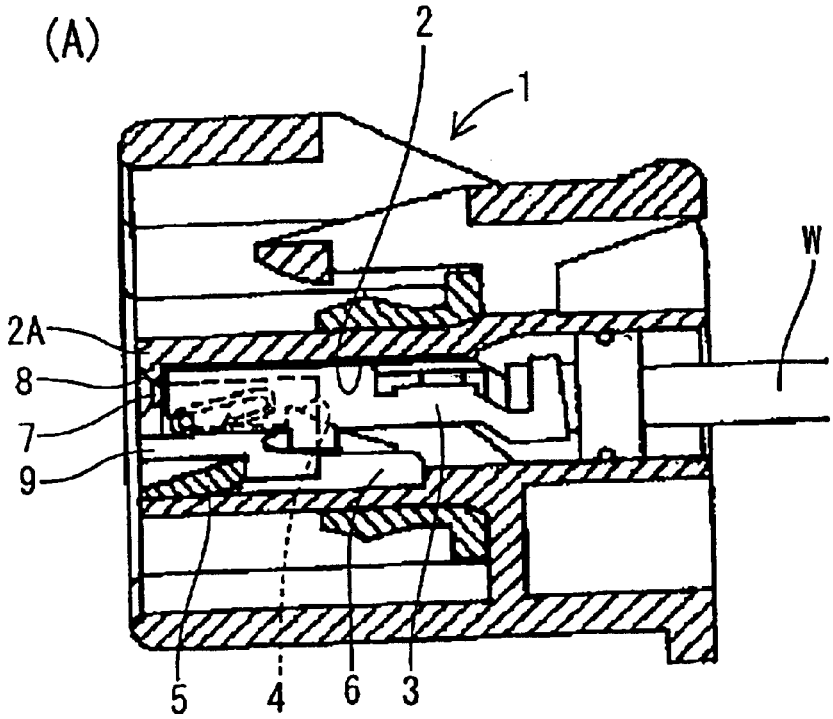
Fig. 17 Prior Art
FIG. 17A is a sectional view showing a conventional art connector.
FIG. 17B is a front view showing a conventional art connector.
Figure 17:
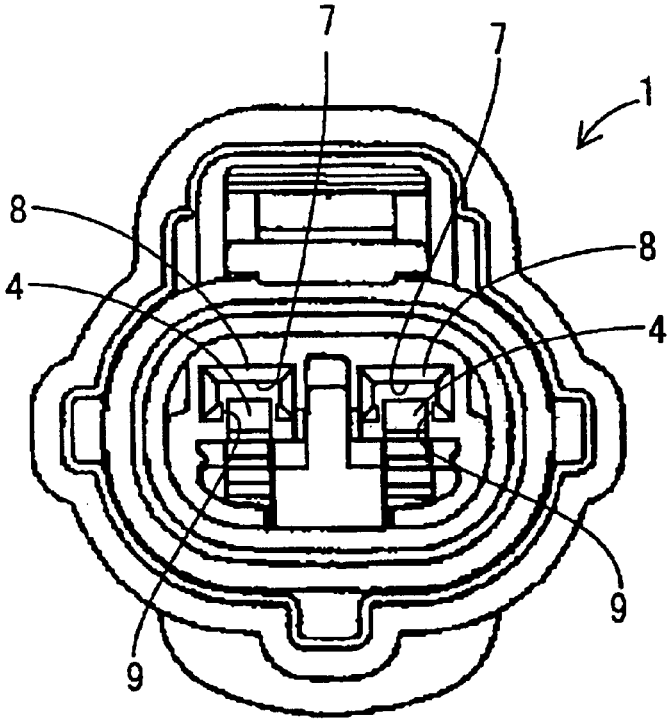
Fig. 17 Prior Art

When the jig J is inserted straight into the cavity 23 from the jig insertion opening 64, formed on the auxiliary plate 60 of the retainer 40, as shown in FIG. 16, an inclined surface J1 at the tip of the jig J strikes the tip of the lance 27. When the jig J is pressed further into the cavity 23, the lance 27 is forcibly elastically deformed into the flexible space 29 by the guide of the inclined surface J1. Accordingly, the projection 28 is unlocked from the locking hole 14. Likewise, the female terminal 10 is unlocked from the lance 27. Thus, by pulling the electric wire W, the female terminal 10 can be pulled rearwardly out of the cavity 23.

As described above, according to the embodiment, the guide surface 33 formed on the peripheral edge of the terminal insertion opening 32 is partly cut off. When the retainer 40 is mounted on the main locking position, the cut-off portion of the guide surface 33 is supplemented with the guide surfaces 33A formed on the auxiliary plate 60. Thus, substantially all the peripheral edge of the terminal insertion opening 32 is surrounded with the guide surfaces 33A and the guide surface 33. Accordingly, irrespective of the inclination direction of the male terminal tab 16 advancing into the terminal insertion opening 32 of the terminal accommodation portion 24, the male terminal tab 16 is inserted straight into the opening 32. The male terminal tab 16 is guided by the guide surfaces 33 or 33A. Accordingly the male terminal 15 can be normally connected to the mating female terminal 10 without the male terminal tab 16 piercing into or striking against an unnecessary portion of the housing.

The present invention is not limited to the embodiment described above with reference to the drawings. For example, the following embodiments are included in the technical scope of the present invention. Further, various modifications of the embodiments can be made without departing from the spirit and scope of the present invention.

The retainer may be constructed to be held directly at the main locking position without being held at a temporary locking position. In the embodiment, the guide surface for supplementing the cut-off portion of the guide surface of the female housing is formed on the retainer. But the guide surface may be formed on another auxiliary member that can be mounted on the female housing but does not have the function of the retainer.

What is claimed is:

1. A connector comprising:

a cavity in a connector housing which receives a female terminal;

an elastically deformable lance, formed on a side wall of said cavity, for unremovably locking said female terminal into said connector housing;

a terminal insertion opening formed on a front wall of said cavity for receiving a tab of a mating male terminal;

a tapered guide surface formed on a front peripheral edge of said terminal insertion opening to guide said tab of said male terminal into said terminal insertion opening;

a jig insertion opening formed forward from said lance by cutting off a part of said front peripheral edge of said terminal insertion opening to enable insertion of a jig for forcibly elastically deforming said lance to unlock said female terminal;

an auxiliary member having a guide surface for supplementing at least one portion of said cut-off part formed thereon can be mounted on said connector housing;

a retainer for unremovably doubly locking said female terminal is mounted in said cavity, said retainer includes said guide surface for partly supplementing said cut-off part, said guide surface cantilevered from said retainer and said retainer has a regulation part aligned with said cantilever for entering a portion of said jig insertion opening for exerting a force on said deformable lance in said locked position with said female terminal for prohibiting removal of said female terminal and an insertion hole under said guide surface and adjacent said regulation part providing an access bore through said retainer into said jig insertion opening when said retainer is in a temporary locked condition, said insertion hole enabling said jig to pass into said jig insertion opening in a substantially straight manner substantially eliminating angling of the jig for contacting said lance for removing said lance from said female terminal to enable removal of said female terminal.

* * * * *